US005117519A

United States Patent [19]

Thomas

[11] Patent Number: 5,117,519

[45] Date of Patent: Jun. 2, 1992

[54] THERAPEUTIC MATTRESS COVER AND METHOD OF MAKING

[76] Inventor: Charles Thomas, 120 E. Golden Gate, Detroit, Mich. 48203-2053

[21] Appl. No.: 753,312

[22] Filed: Aug. 30, 1991

[51] Int. Cl.[5] ..... A47G 9/04

[52] U.S. Cl. ..... 5/500; 5/464; 5/903; 112/262.1

[58] Field of Search ..... 5/502, 500, 499, 470, 5/485, 486, 464, 465, 482; 112/262.1

[56] References Cited

U.S. PATENT DOCUMENTS

| | | | |
|---|---|---|---|
| 2,021,237 | 11/1935 | Karr | 5/500 |
| 2,856,615 | 10/1958 | Cirocco | 5/500 |
| 4,274,169 | 6/1981 | Standiford | 5/502 |
| 4,922,564 | 5/1990 | Thomas | 5/448 |
| 5,010,610 | 4/1991 | Ackley | 5/502 |

FOREIGN PATENT DOCUMENTS

| | | | |
|---|---|---|---|
| 369557 | 7/1963 | Switzerland | 5/485 |
| 823166 | 11/1959 | United Kingdom | 5/502 |
| 927094 | 5/1963 | United Kingdom | 5/485 |

*Primary Examiner*—Alexander Grosz
*Attorney, Agent, or Firm*—Dykema Gossett

[57] ABSTRACT

A therapeutic mattress cover includes overlying first and second fabric sheets of rectangular shape. Laterally spaced rows of first stitching interconnect the sheets throughout their width. A hollow rectangular skirt at its top edge overlies the perimeter of the sheets and depends therefrom. A second peripheral stitching connects the top edge of the sheet with the corresponding two ends and one side of the sheets defining with the first stitching a plurality of transverse tubes with the second stitches closing one end of the tubes. A filler pad of a foam plastic resilient material is nested within each tube, and third stitching connects the remaining side of the skirt to the remaining side of the sheets closing the other end of the tube. The method of making a therapeutic mattress cover comprises stacking first, second and third fabric sheets and applying a plurality of laterally spaced rows of first stitching interconnecting the sheets throughout their width. Superimposing a hollow continuous skirt to overlie and surround the perimeter of the sheets and applying second continuous peripheral stitching connecting the top edge of the skirt to corresponding two ends and one side of the sheets defining with the first stitching a first set of transverse tubes along the length of the first and second sheets and a second set of transverse tubes underlying the first set of tubes with the second stitching closing one end of the tubes. Inserting a filler pad of a foam plastic resilient material into each tube and applying third stitching connecting the remaining side of the skirt to the remaining side of the sheets.

4 Claims, 2 Drawing Sheets

THERAPEUTIC MATTRESS COVER AND METHOD OF MAKING

FIELD OF THE INVENTION

The present invention relates to mattress covers and a method of making, and more particularly to a mattress cover with a plurality of sheets of fabric, a series of stitching to provide a plurality of tubes with resilient insert pads.

BACKGROUND OF THE INVENTION

Previously mattress covers have been used to protectively cover a mattress and to some extent smooth out the conventional surface irregularity and tufting of mattresses. Mattresses heretofore have been constructed of top and bottom covers of a fabric material and interposed cotton and other resilient material with portions of the top and bottom covers of the mattress quilted or interconnected to define a mattress of substantially uniform resistance throughout its length and width. One of the disadvantages of the conventional mattress is that it is of a substantial and uniform resiliently throughout its length and width such that the user receives a uniform support for his entire body. Under some circumstances this may result in backache or other discomforts after usage. Previously known mattresses do not give individual or more firm support for certain specific areas of the user's body as for example the head, back, torso, knees, legs and feet. On the other hand, most mattresses provide a substantial resilient support for the body of a uniform nature, regardless of the position of the user's body making indentations into the mattress depending upon its degree of firmness.

Recognizing the need for a therapeutic mattress the present inventor has provided a therapeutic mattress and method of making such as disclosed in U.S. Pat. No. 4,922,564 dated May 8, 1990. Here the mattress comprises a soft and resilient bottom mattress section together with a plurality of interconnected top mattress sections peripherally interconnected. The top section included top and bottom fabric covers peripherally interconnected together with a plurality of rows of stitching to interconnect the top and bottom covers and with the peripheral stitching defining a plurality of transverse rectangular tubes which were filled with a compacted resilient fibrous material. The bottom mattress section includes a bottom fabric cover spaced from the bottom cover of the top section and peripherally connected to define an elongated chamber underlying the top mattress section. A loosely confined resilient fibrous material was contained within the chamber yieldably underlying the top mattress section.

Also the prior art includes Applicant's U.S. Pat. No. 4,995,220 dated Feb. 26, 1991, as a division of the earlier filed patent directed to the method of making a therapeutic mattress of the type disclosed in U.S. Pat. No. 4,922,564 of the present Applicant.

SUMMARY OF THE INVENTION

The present invention takes into consideration some of the problems recognized in the earlier above-mentioned United States patents providing for the improvement of a mattress construction but at the same time recognizes that for existing mattresses already in the market the problem can be solved in many situations by an improved therapeutic mattress cover and method of making which forms a part of the present invention.

An important feature of the present invention is to therefore provide a therapeutic mattress cover which is adapted to overlie the conventional mattress which includes a series of fabric strips. These are transversely stitched together and interconnected to provide a series of transverse tubes and wherein by a series of additional stitching a conventional skirt is connected to the stack of strips of fabric material to thereby define with the first transverse stitching a series of tubes and wherein within each tube there is inserted an elongated flexible and resilient pad or strip of a plastic material. Additional stitching between the skirt and the strips and the stack of sheets and tubes closes off the respective tubes and the resilient pads therein.

It is a further feature to provide a plurality of laterally connected resilient body support sections of varying widths arranged side by side along the length of the mattress pad.

Another feature is to provide for the conventional mattress, whether it be a standard size, king size, queen size, or a twin size an overlying therapeutic mattress cover wherein the cover includes multiple layers of fabric sheeting with stitching to interconnect the sheeting peripherally as well as crosswise to define a series of tubes in either one set or in two sets with one set underlying the other. The respective tubes receive a filler strip of a foam plastic resilient material, snugly nested therein. Additional stitching connects the remaining side of the skirt to the top edge of the sheets for closing off the tubes and for retaining the filler strips therein.

As a further feature the present therapeutic mattress cover may include merely a pair of fabric sheets of rectangular shape and spaced sides and ends with a plurality of laterally spaced rows of first stitching intermediate the ends of the sheets and interconnecting the first and second sheets throughout their width. A skirt having a top edge overlies and surrounds the perimeter of the sheets and depends therefrom. Second stitching connects the top edge of the skirt with corresponding two ends and one side of the sheets to define a plurality of transverse tubes along the length of the sheets extending between their sides. A filler pad of a foam plastic resilient material is snugly nested within each tube. Third stitching interconnects the remaining one side of the skirt at its top edge to the remaining side of the first and second sheets closing off the tubes and retaining the filler pads therein.

As a further feature, the therapeutic mattress cover may include three such fabric sheets to thereby define with the first and second stitching, a first set of transverse tubes along the first and second sheets and a second set of transverse tubes along the length of the second and third sheets underlying the first set of tubes. Each of the tubes have inserted therein an elongated foam plastic pad of a resilient material. Additional stitching interconnects the remaining one side of the skirt to the remaining side of the sheets to close off the tubes and retain the filler pads therein.

As another feature a modification of the present therapeutic mattress cover includes a plurality of sheets of fabric material and wherein interposed between the respective sheets are a pair of elongated pads of resilient plastic porous material of the same size and rectangular shape as the sheets of fabric. Transverse stitching connects all the sheets and pads together. A peripheral stitching around the sheets and pads completes a therapeutic mattress cover. There is further defined by said stitching a plurality of body support sections of a therapeutic character and for improved body support of the mattress user.

These and other features and objects will be seen from the following specification and claims in conjunction with the appended drawings.

THE DRAWINGS

It will be understood that the above drawings are illustrative of preferred embodiments of the invention and the preferred steps in the method of making said mattress cover and other embodiments thereof, and that other embodiments and steps are contemplated within the scope of the claims hereafter set force.

DETAILED DESCRIPTION OF AN EMBODIMENT OF THE INVENTION

Figure 1:
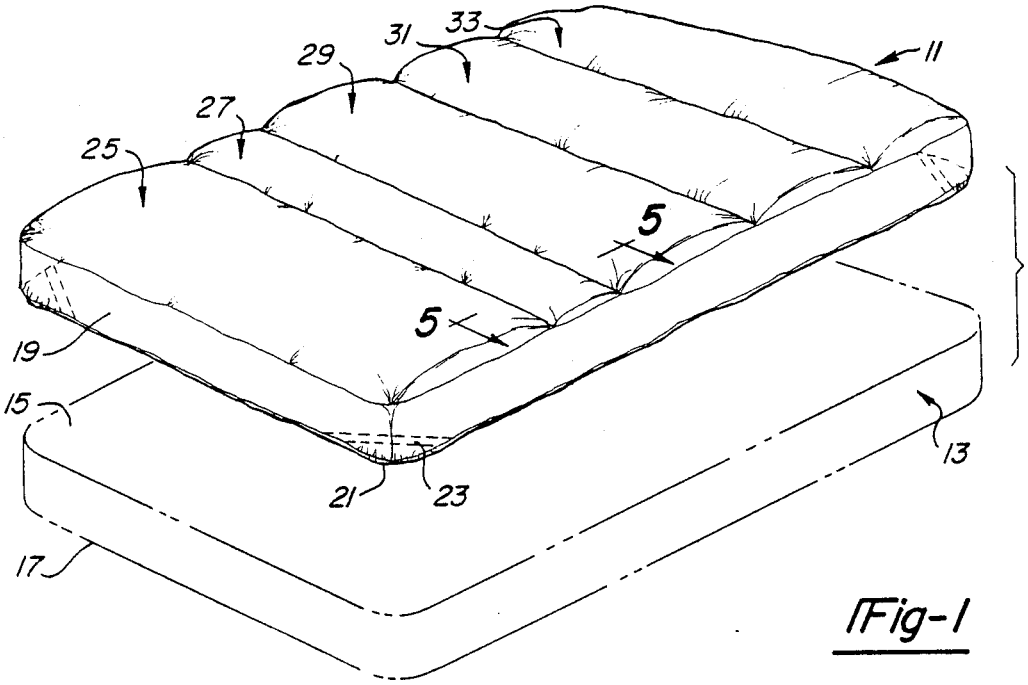
FIG. 1 is a perspective exploded view of the present therapeutic mattress cover overlying a standard mattress onto which it is assembled.
Figure 2:
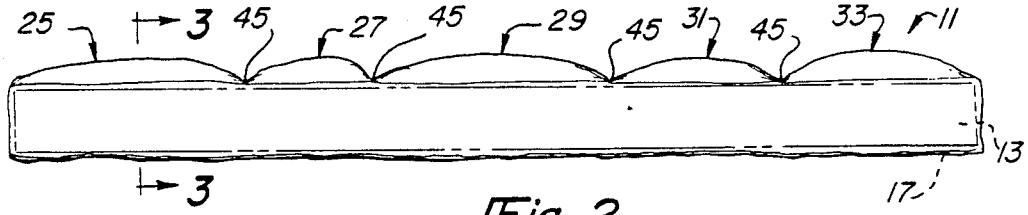
FIG. 2 is a side elevational view of the present mattress cover assembled over the mattress shown in FIG. 1.

Referring to the drawings the present therapeutic mattress pad is generally designated at 11, FIGS. 1 and 2, as overlying the conventional mattress 13 having a top surface 15 and a bottom portion 17.

Figure 3:
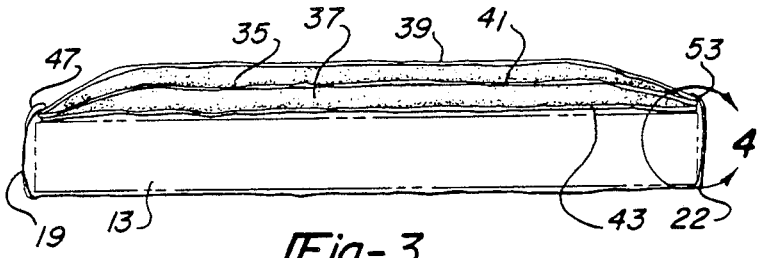
FIG. 3 is a transverse section taken in the direction of arrows 3—3 of FIG. 2.
Figure 4:
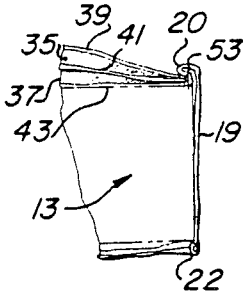
FIG. 4 is an enlarged section end portion of the mattress designated at 4 in FIG. 3.
Figure 5:
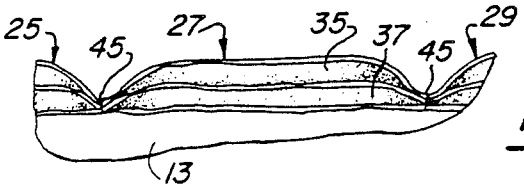
FIG. 5 is a fragmentary section of a portion of the mattress cover and mattress of FIGS. 1 and 2 and taken in the direction of arrows 5—5 of FIG. 1.

Hollow rectangular skirt 19 has top and bottom edges, with its top edge 20 overlying and surrounding the perimeter of the fabric sheets 39, 41 and 43, such as shown in FIG. 3.

As is conventional with mattress covers the present skirt includes adjacent its bottom edge gathered elastic corners 21, FIG. 1, cooperatively and retainingly engaging corresponding outer corners of the underlying mattress 13. Each of the respective corners of the mattress pad 11 at the lower edges 22 of the skirt have elastic corner anchor strips 23, FIG. 1. These in a conventional manner underlie and retainingly engage under surface or bottom portions 17 of the mattress 13. This holds the mattress cover in position thereon.

The present mattress cover in the completed assembly includes a plurality of sections 25, 27, 29, 31 and 33, FIG. 1. These sections when properly overlying the top surface 15 of mattress 13 are adapted at section 25 to support the feet and legs and is about 17" wide, approximately. Section 27 supports the user's knees, and is about 11" wide. Section 29 supports the torso and is about 20" wide. Section 31 supports the back and is about 15" wide. Section 33 is for the head and is about 11 inches wide. These dimensions may vary plus or minus 3", approximately, depending upon the size of the underlying mattress, whether it be standard mattress, a king or queen size or a twin size.

The respective sections are referred to as body support sections for the more comfortable use of the mattress when the therapeutic mattress pad 11 has been applied over the mattress in the assembled view, FIG. 2.

Figure 9:
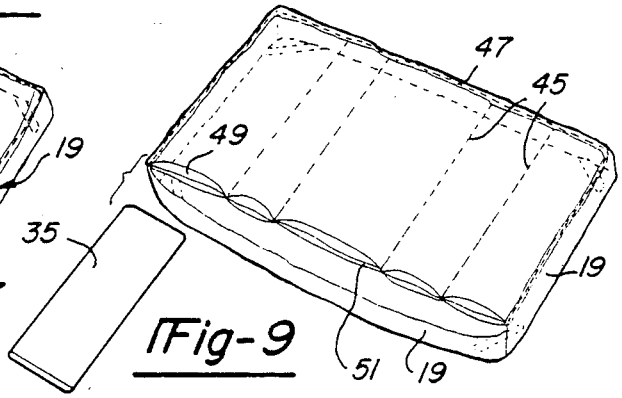
FIG. 9 is a perspective view of the mattress pad assembly shown in FIG. 8 and designating the insertion of a filler pad within one of the tubes forming a part of the mattress cover.
Figure 10:
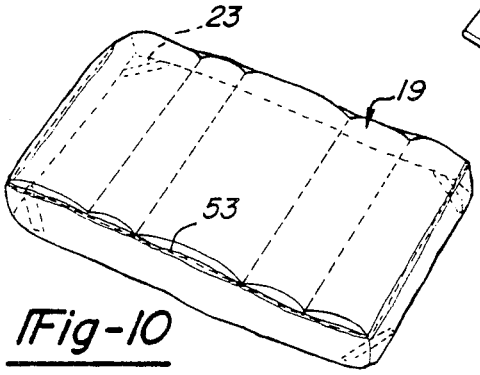
FIG. 10 illustrates the final assembly step in completing the mattress cover with the last stitching employed.

Each of the respective sections includes a top filler pad 35 of a foam plastic resilient material and a bottom filler pad 37 of the same material, for illustration. A filler pad 35, such as shown in FIG. 9 is of a suitable polyester foam sheet normally cut from a roll of such material to the correct width and length. This resilient material is available on the market under the name Hollofill, trademark and the name Marifill both trademarks of the DuPont Company.

In the construction of the present mattress pad and in accordance with the present method of making there is provided a top sheet 39 of a fabric material, such as muslin or cotton or the like, of rectangular shape, a center or second sheet 41 of the same size and shape and an underlying bottom sheet 43 of the same shape of material cotton, polyester or a mixture or muslin. The respective sheets are superimposed and stacked in FIG. 6, in accordance with the present method and assembled, FIG. 7.

Figure 7:
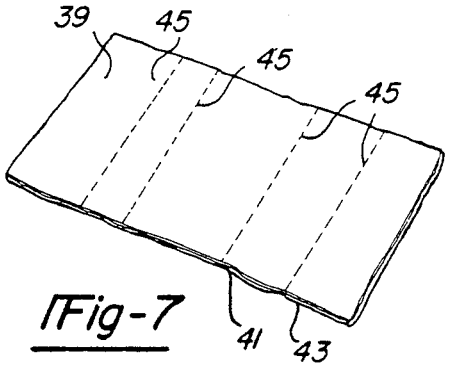
FIG. 7 is a perspective view of the three sheets of fabric material assembled and interconnected by transverse stitching.

A plurality of laterally spaced rows of first continuous transverse stitching 45 are arranged intermediate the ends of the sheets 39, 41 and 43 and interconnect these sheets throughout their width, FIG. 7.

Figure 8:
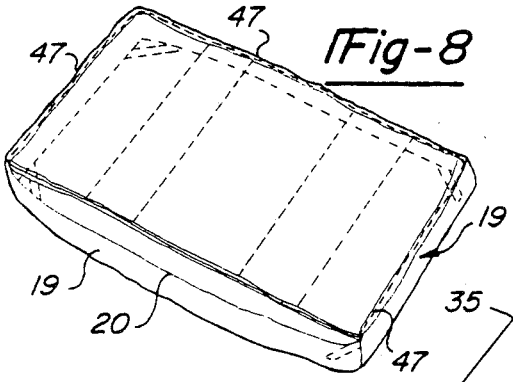
FIG. 8 is a perspective view of the assembled strips of fabric material and a skirt as a further step stitched on three sides.

The hollow rectangular skirt 19 of FIG. 3 which has top edge 20 and bottom edge 22, at its top edge is assembled upon and overlies and surrounds the perimeter of the stacked sheets 39, 41 and 43, FIG. 8, and depends therefrom. The second continuous peripheral stitching 47 connects the top edge of the skirt 19 with the corresponding two ends and one side of the sheets 39, 41 and 43, FIG. 8, to thereby define a plurality of transverse top tubes 49 and corresponding bottom tubes 51, FIG. 9.

The respective tubes extend along the length of the respective sheets 39, 41 and 43 and between their sides. The second stitching 47 closes the one end of the respective tubes.

The top filler pads 35 of a foam plastic resilient material are snugly nested within the top tubes 49 along their length. Bottom filler pads 37 of a foam plastic resilient material are snugly nested within each of the respective bottom tubes 51.

As a final step in completing the embodiment in FIGS. 6-10 there is a third stitching 53 applied to the final side of the skirt 19 which connects that side at its top edge 20 to the remaining side of the first, second and third sheets 39, 41 and 43. This closes off the other ends of the respective tubes 49 and 51 and retains the respective filler pads 35 and 37 therein.

In one form of the present therapeutic mattress cover only the fabric strips 39 and 41 are required. These are referred to as the first and second fabric sheets of rectangular shape. There is provided a plurality of laterally spaced rows 45 of first continuous transverse stitching between the sheets and interconnecting the first and second sheets throughout their widths, FIG. 7.

Thereafter the hollow rectangular skirt 19 having a top edge 20 and a bottom edge 22, at its top edge overlies and surrounds the perimeter of the two sheets and depends therefrom. Second continuous peripheral stitching 47, FIG. 8, connects the top edge 20 of the skirt with the corresponding two ends and one side of the sheets 39 and 41 to define the plurality of transverse tubes 49 along the length of the sheets and extending between their sides. The second stitching 47 closes the one ends of said tubes. In this embodiment a filler strip 35 of a foam plastic resilient material is snugly nested within each of the tubes 49. Third stitching 53 connects the remaining one side of the skirt at its top edge to the remaining side of the first and second sheets 39 and 41 closing off the respective tubes 49 and retaining the filler pads 35 therein.

Figure 6:
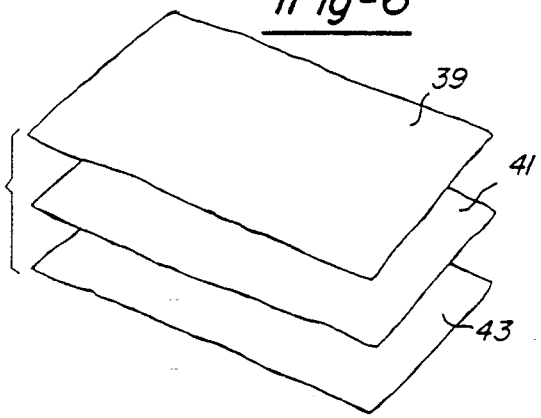
FIG. 6 is a front perspective view of the first step in the making of the present therapeutic mattress cover.

In the preferred embodiment, FIG. 6, there are provided the three sheets 39, 41 and 43 to thereby provide with the first stitching 45 and the second stitching 47 the two sets of tubes 49 and 51. In this embodiment involving the three sheets 39, 41 and 43 of rectangular shape, the second stitching 47 along with the first stitching 45 defines the respective top and bottom tubes 49 and 51, FIG. 9. The final stitching 53, FIG. 10, connects the remaining one side of the skirt to the remaining one side of the three strips 39, 41 and 43. This effectively closes off the respective tubes after the insert pads 35 and 37 have been inserted therein to complete the construction, FIGS. 1 and 3.

The respective tubes 35 and 37 throughout the length of the respective sheets define a plurality of laterally connected resilient body support sections 25, 27, 29, 31 and 33 of varying width and arranged side by side, FIGS. 1 and 2.

Figure 11:
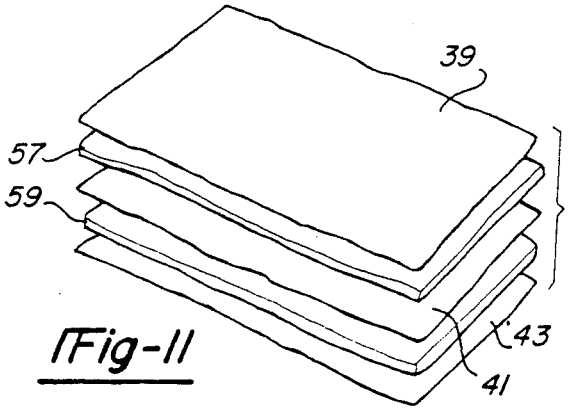
FIG. 11 is a perspective view of a stack of fabric sheets with interposed sheets of foam plastic resilient material interposed between the sheets as a first step in the method of making of a modified mattress cover.
Figure 12:
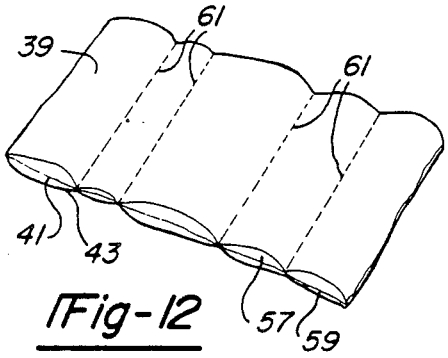
FIG. 12 is a top front perspective view illustrating a further step with the first set of stitching applied to the assembly shown in FIG. 11.
Figure 13:
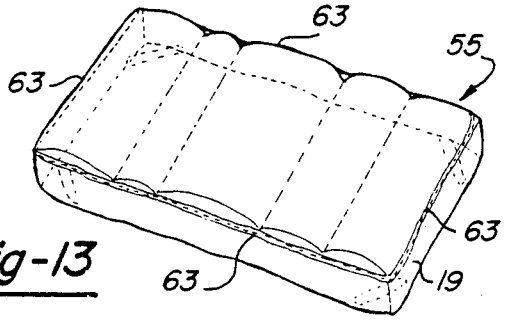
FIG. 13 is a front perspective view of the final stitching step completing the assembly of the modified therapeutic mattress cover.

In a modification disclosed in FIGS. 11, 12 and 13, the mattress pad 55 of FIG. 11 in addition to the three stacked sheets 39, 41 and 43 includes the top foam filler pad 57 of a foam plastic resilient material interposed between sheets 39 and 41. A second bottom foam insert pad 59 of a foam plastic flexible resilient material is interposed between sheets 41 and 43.

The first transverse stitching 61 extends across the width of the respective three sheets of fabric material 39, 41 and 43 and the widths of the respective interposed top and bottom unit foam pads 57 and 59.

Second peripheral stitching 63 extends throughout 360 degrees around the assembly shown in FIGS. 11 and 12 thereby completing the modified mattress pad, FIG. 13.

In this construction there is defined within the modified therapeutic mattress cover a plurality of body support sections similar to and corresponding to the sections 25, 27, 29, 31 and 33 of FIG. 1. These sections are arranged side by side to extend across the respective mattress cover and throughout its length.

The respective first stitching 45, second stitching 47 and the third stitching 53 of FIGS. 6–9 as well as the first stitching 61 and second stitching 63, FIGS. 12 and 13, are adapted to compress adjacent portions of the respective sheets of fabric and interposed resilient pads 35 and 37 at their ends and upon their adjacent side edges. Their respective body support sections 25–33 in FIG. 1 and the corresponding sections shown in FIG. 13 are tapered at their margins and where the sections connect each other laterally. This provides a plurality of resilient body support sections as a part of the therapeutic mattress cover for the comfort of the user when applied to a conventional mattress, FIGS. 1 and 2.

Having described my invention reference should now be had to the following claims.

I claim:

1. A therapeutic mattress cover comprising:

a first fabric sheet of rectangular shape;

a second fabric sheet of rectangular shape underlying the first sheet;

a third fabric sheet of rectangular shape underlying said second sheet;

said sheets having spaced sides and ends;

a plurality of laterally spaced rows of first continuous transverse stitching intermediate the ends of said sheets interconnecting said sheets throughout their width;

a hollow rectangular skirt having top and bottom edges, at its top edge overlying and surrounding the peripheral edges of said sheets and depending therefrom;

second continuous peripheral stitching connecting the top edge of said skirt with the corresponding two ends and one side of said sheets defining with said first stitching a first set of transverse tubes along the lengths of said first and second sheets extending between their sides, and a second set of transverse tubes along the length of said second and third sheets, extending between their sides and underlying said first set of tubes, respectively;

said second stitching closing one end of said tubes;

an elongated filler pad of a foam plastic resilient material snugly nested within and along the length of each tube; and third stitching connecting the remaining one side of said skirt at its top edge to the remaining side of said sheets closing off all of said tubes and retaining said filler pads therein; said first and second stitching defining both sets of tubes and closing their one ends; said third stitching closing the open ends of all tubes, wherein said tubes throughout the length of said sheets define a plurality of laterally connected resilient body support sections of varying widths, arranged side-by-side and adapted to support a user's feet and legs, knees, torso, back, and head.

2. In the therapeutic mattress cover of claim 1, further comprising said widths being approximately 17" for the user's feet and legs, 11' for the knees, 20" for the torso, 15" for the back, and 11" for the head, plus or minus 3" depending upon the size of the mattress cover for a corresponding mattress.

3. In the therapeutic mattress cover of claim 1, said foam plastic material being a polyester foam.

4. The method of making a therapeutic mattress cover comprised of a plurality of tubes defining a plurality of laterally connected resilient body support sections of varying widths, arranged side by side and adapted to support a user's feet and legs, knees, torso, back, and head, comprising the steps of:

stacking first, second and third fabric sheets of rectangular shape of the same area;

applying a plurality of laterally spaced rows of first stitching intermediate the ends of said sheets interconnecting said sheets throughout their width;

superimposing a hollow continuous skirt having top and bottom edges with its top edge overlying and surrounding the perimeter of said sheets and depending therefrom;

applying second continuous peripheral stitching connecting the top edge of said skirt with the corresponding two ends and one side of said sheets defining with said first stitching a first set of transverse tubes along the length of said first and second sheets extending between their sides, and a second set of transverse tubes along the length of said second and third sheets underlying said first set of tubes, respectively, said second stitching closing one end of said tubes;

inserting a filler pad of a foam plastic resilient material successively into and along the length of each tube; and applying third stitching connecting the remaining one side of said skirt at its top edge to the remaining side of said sheets, closing off said tubes and retaining the filler pads therein.

* * * * *